US008273214B2

(12) United States Patent
Droux et al.

(10) Patent No.: US 8,273,214 B2
(45) Date of Patent: Sep. 25, 2012

(54) MANUFACTURE OF A VEIL MADE OF GLASS AND CELLULOSE FIBERS IN CATIONIC MEDIUM

(75) Inventors: Michel Droux, La Ravoire (FR); Carl Desaint Jean, Saint-Pierre d'Albagny (FR)

(73) Assignee: Saint-Gobain Technical Fabrics Europe, Chambery (FR)

( * ) Notice: Subject to any disclaimer, the term of this patent is extended or adjusted under 35 U.S.C. 154(b) by 0 days.

(21) Appl. No.: 13/355,596

(22) Filed: Jan. 23, 2012

(65) Prior Publication Data

US 2012/0118521 A1 May 17, 2012

Related U.S. Application Data

(63) Continuation of application No. 10/541,121, filed as application No. PCT/FR2004/000014 on Jan. 7, 2004, now Pat. No. 8,157,957.

(30) Foreign Application Priority Data

Jan. 8, 2003 (FR) ..... 03 00125

(51) Int. Cl.
*D21F 11/00* (2006.01)

(52) U.S. Cl. ..... 162/141

(58) Field of Classification Search ..... 162/141, 162/164.1, 190
See application file for complete search history.

(56) References Cited

U.S. PATENT DOCUMENTS

| | | | |
|---|---|---|---|
| 4,112,174 | A | 9/1978 | Hannes et al. |
| 5,518,586 | A | 5/1996 | Mirous |
| 5,837,620 | A | 11/1998 | Kajander |
| 6,251,224 | B1 | 6/2001 | Dong |
| 6,303,207 | B1 | 10/2001 | Kajander |
| 6,488,811 | B1 | 12/2002 | Dong |
| 7,402,225 | B2 | 7/2008 | Droux |
| 2005/0244624 | A1 | 11/2005 | Droux |

FOREIGN PATENT DOCUMENTS

| | | |
|---|---|---|
| GB | 753 485 | 7/1956 |
| WO | WO 99/13154 | 3/1999 |
| WO | WO 01/11138 | 2/2001 |

*Primary Examiner* — Mark Halpern
(74) *Attorney, Agent, or Firm* — Oblon, Spivak, McClelland, Maier & Neustadt, L.L.P.

(57) ABSTRACT

A process for producing a veil comprising glass fibers and cellulose fibers which includes dispersing cellulose fibers and chopped glass fibers into a white water, forming a bed in a forming device by passage of the dispersion over a forming fabric through which the white water is drained off, the fibers being retained on the fabric and the dispersion including, during passage, a cationic white water, and performing a heat treatment step an oven device.

12 Claims, 1 Drawing Sheet

MANUFACTURE OF A VEIL MADE OF GLASS AND CELLULOSE FIBERS IN CATIONIC MEDIUM

REFERENCE TO PRIOR APPLICATIONS

Figure 1:
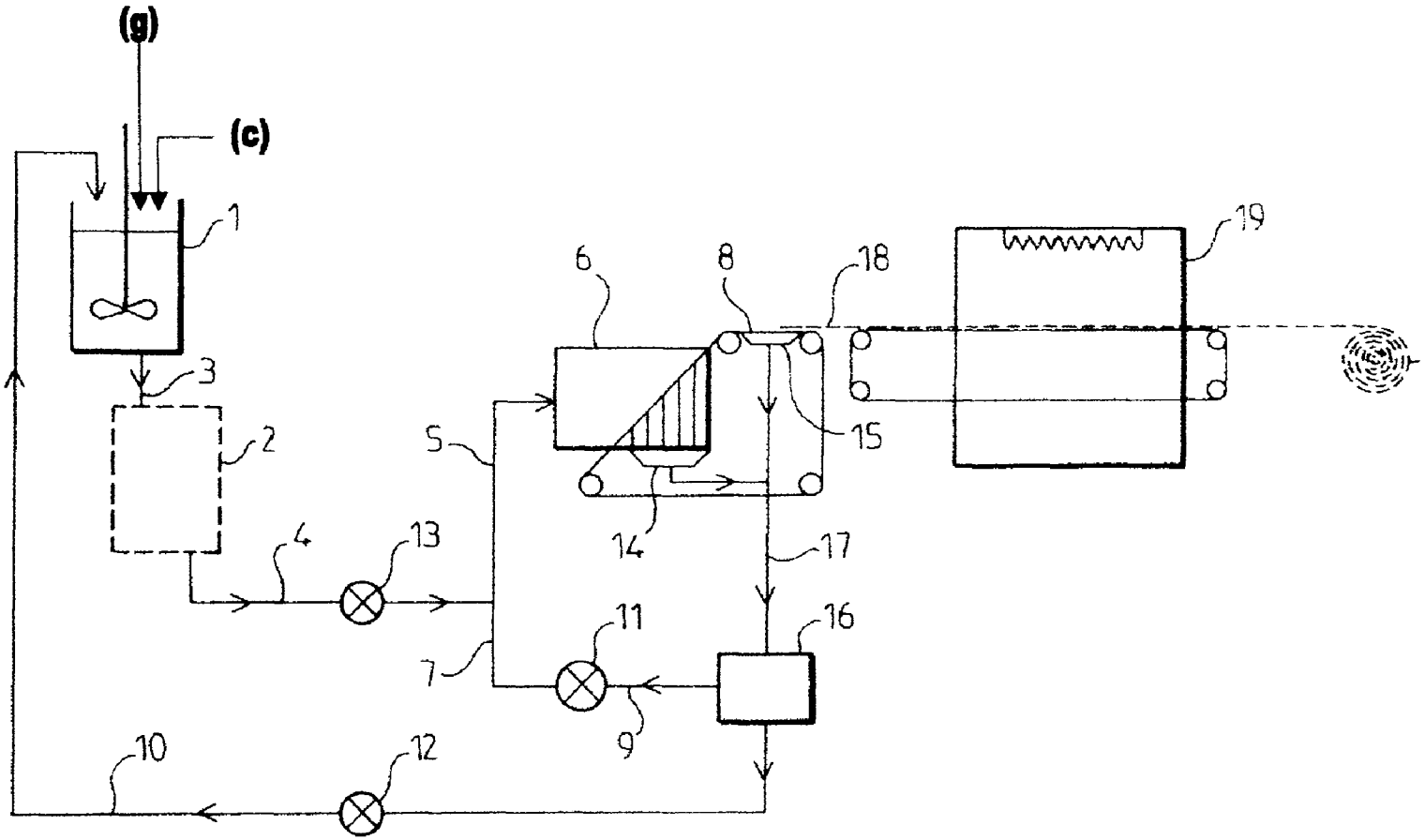

This application is a division of U.S. patent application Ser. No. 10/541,121, filed Jun. 30, 2005, which is the U.S. national stage of International Application No. PCT/FR04/00014, filed Jan. 7, 2004, the disclosures of which are incorporated herein by reference in their entireties. This application is a U.S. counterpart of WO 2004/070112, the text of which is herein incorporated by reference in its entirety. This application claims priority to French Patent Application No. 03/00125, filed Jan. 8, 2003, the disclosure of which is incorporated herein by reference in its entirety.

The invention relates to a process for manufacturing, in cationic medium, a veil comprising glass fibers and cellulose fibers.

Veils comprising cellulose fibers and glass fibers exhibit both a high tensile strength and a high tear strength. This combination of properties makes this type of material an excellent candidate for reinforcing shingles, often called Canadian shingles. Such shingles are generally obtained by impregnating a fibrous structure such as a veil with a tar or asphalt.

The term "veil" is understood to mean a nonwoven consisting of completely dispersed filaments. The veils of the present invention generally have a weight per unit area ranging from 20 to 150 g/m$^2$ and more particularly 30 to 130 g/m$^2$, for example about 100 g/m$^2$.

WO 99/13154 teaches a wet method of preparation for a glass/cellulose veil containing 5 to 15% binder. According to that document, the fibers are dispersed in the presence of an anionic viscosity modifier (Nalco 2388) and a dispersant, the nature of which is not specified.

WO 01/11138 teaches a two-step method of preparation comprising a first step of preparing a suspension comprising cellulose fibers and a cationic polymer and a second step of preparing a suspension comprising glass fibers, a dispersant and a viscosity modifier, these two suspensions then being combined before passage over a forming fabric. That document teaches nothing about the ionicity or nonionicity of the white water during its passage over the forming fabric.

The aqueous solution in which the fibers are dispersed is called white water. The Applicant has discovered that the nature of the ionicity of the white water during passage of the suspension comprising the two types of fiber over the forming fabric assumes great importance in respect of the quality of the dispersion itself and consequently the homogeneity of the veil formed. The process according to the invention is particularly simple as it allows both the glass fibers and the cellulose fibers to be put into suspension in a single step, directly into the white water.

The continuous manufacture of a veil involves the passage of a bed of dispersed fibers through a combination of several successive devices, each having to apply a particular treatment to said fibers. The fiber bed, after it is formed in a "forming device", if appropriate, then passes through a "binder deposition device" followed by an "oven device". The bed is transported through these devices by conveyor belts, it being in general possible for the bed to be passed from one belt to another.

The process according to the invention comprises:

a step of dispersing cellulose fibers and chopped glass fibers into a white water; then a step of forming a bed in a forming device by passage of the dispersion over a forming fabric through which the white water is drained off, the fibers being retained on said fabric and said dispersion exhibiting, during said passage, a positive ionic (i.e. cationic) charge owing to the fact that the white water at this instant is itself cationic, preferably such that 10 milliliters of white water at this instant can be neutralized by 1 to 4 milliliters of a $1.10^{-3}$ N anionic titrating solution; and then a heat treatment step in an oven device.

According to the invention, the white water is cationic at least as soon as fibers start to be added thereto. Preferably, the white water and the dispersion that it contains remains cationic at least until passage over the forming fabric. In a continuous process that recycles the white water, the latter is in general always cationic. Thus, the process may be continuous, the white water being recycled and exhibiting cationicity throughout its circulation loop.

The cationicity of the white water arises from a favorable dispersion of the glass and cellulose fibers as soon as these are introduced into said white water, until passage over the forming fabric. Thus, according to the invention, it is unnecessary to prepare a cationic-type predispersion of one of the types of fiber (cellulose or glass) before mixing said fibers with the other type of fiber. In particular, it is therefore unnecessary, for example, to apply a cationic polymer (or another product exhibiting cationicity) to the cellulose in a prior dispersion, before mixing said cellulose with the glass fiber into the white water. Nor is it necessary to apply a cationic polymer (or another product exhibiting cationicity) to the glass fiber in a prior dispersion, before mixing said glass fiber with the cellulose into the white water. Thus, neither the cellulose fiber, nor the glass fiber are generally treated by a cationic species before they are introduced into the white water.

Maintaining cationicity of the white water does not exclude the presence in said white water, if necessary, of ingredients having an anionic, nonionic or amphoteric (i.e. both cationic and anionic) character since, in general, the overall cationicity of the white water is ensured by the presence of at least one other ingredient exhibiting cationicity. In general, the white water contains at least one cationic dispersant in an amount sufficient for the white water to be cationic.

The ionicity of the white water may be determined by potentiometric titration. To do this, a particle charge detector, such as that of the Mütek PCD 03 brand and a Mütek Titrator PCD-Two titrator may especially be used. The principle of the method consists in neutralizing a specified volume (for example 10 ml) of white water, the cationicity of which it is desired to determine, by a measured volume of an anionic aqueous titrating solution. As titrating solution, a solution of sodium polyethylene sulfonate (Na-PES), for example with a concentration of $10^{-3}$ N, may be used for example. The cationicity of the white water may be expressed as the number of milliliters of Na-PES solution needed to neutralize 10 milliliters of titrated white water.

Preferably, the white water is cationic to the extent that 10 ml of white water can be neutralized by 1 to 10 ml of a $10^{-3}$ N anionic titrating solution and more preferably by 1.5 to 4 ml of said anionic titrating solution.

This also amounts to saying that, preferably, the white water is cationic from $1.10^{-4}$N to $1.10^{-3}$ N and even more preferably from $1.5.10^{-4}$N to $4.10^{-4}$ N.

To be dispersed in the white water, the fibers must be able to remain in the individual state and not agglomerate when mixed into the white water. If chopped strands (fiber assemblies) are dispersed in the white water, these strands must be able to break up into filaments as a dispersion in the white water. The term "strand" is understood to mean an assembly of contiguous filaments, more particularly comprising 10 to 2000 fibers. Thus, the fibers may be introduced into the white water in the form of strands comprising more particularly 10 to 2000 fibers.

The glass fibers may be sized during their manufacture, in order to be combined, where appropriate, in the form of strands, especially by sizing liquids comprising an organosilane and/or a film former. It is preferable in this case not to dry the fibers before they are dispersed in the water, so as to prevent them from bonding together, which would impede their dispersion into the state of being individual filaments.

The cellulose fibers are generally obtained from a wood pulp. This wood pulp is in general obtained from commercial sheets of board that are softened with water. This water used to soften the board then is used to transport the pulp into the plant for producing the dispersion. This water/pulp mixture generally contains just enough water to be able to convey the pulp by flow. This pulp/water mixture before achieving the medium of the dispersion generally contains 70 to 99% water by weight and 1 to 30% cellulose by weight.

The operation of dispersing both types of fiber in the white water may be carried out for example in a pulper. This dispersion operation may be carried out firstly in a pulper for example, with a proportion of fibers such that the sum of the glass fiber mass+cellulose fiber mass ranges from 0.01% to 0.5% by weight of the sum of the weight of the fibers and of the white water.

Preferably, the fiber/white water dispersion at the moment of passing into the step of forming the bed on the forming fabric is such that the sum of the mass of the fibers represents 0.01 to 0.5% by weight of said dispersion and preferably 0.02 to 0.05% by weight of said dispersion. The dispersion may suffer a reduction in fiber concentration on passing from the pulper into the bed-forming device.

In the white water, the ratio of the mass of the glass fibers to the mass of the cellulose fibers is the same as that desired in the final veil.

The white water may include a thickener in order to increase the viscosity of the white water. This thickener may be present in an amount from 0 to 0.5% by weight in the white water. This thickener may for example be a hydroxyethyl cellulose (for example Natrosol 250HHR from Hercules). Hydroxyethyl cellulose is an anionic-type compound.

The white water generally includes a cationic dispersant. This cationic dispersant may in general be present in an amount from 0 to 0.1% by weight in the white water. For example, this cationic dispersant may be guanidine or a fatty-chain amine. In particular, AEROSOL C 61 sold by Cytec may be used. It may also be a polyoxylated alkylamine.

Preferably, the thickener is introduced to the extent that the white water has a viscosity at 20° C. of between 1 and 20 mPa·s and preferably between 3 and 16 mPa·s.

The white water/fiber dispersion is stirred and then sent to a permeable forming fabric that allows the white water to flow away through it and retains the fibers on its surface. The white water may be sucked out in order to improve its removal. The white water may be recycled in order again to be mixed with fibers. The fibers thus form a bed on the surface of the forming fabric.

It is unnecessary to make the formed bed pass through a device for applying a binder if a binder or a binder precursor for the final veil has already been put into the dispersion.

However, in general the dispersion does not contain the binder or the precursor of the final binder, and this binder or this binder precursor is generally applied to the veil in a device for applying the binder or its precursor that is placed between the bed-forming step and the heat treatment step.

The final veil (dry after heat treatment) generally comprises 8 to 27% binder by weight and more generally 15 to 21% binder by weight, the remainder of the mass of the veil generally consisting of the mass of fibers, which includes the possible sizing products that coat them. Thus the final veil generally comprises:

2 to 12% cellulose,
70 to 80% glass, and
8 to 27% binder.

If it is chosen to apply at least part of the total binder by a binder application device, the binder is generally applied in the form of an aqueous dispersion:

- either by immersion between two forming fabrics, in which case the product held between the two fabrics is dipped into a bath by means of pairs of rolls;
- or by deposition on the fiber bed, by a cascade, which means that the aqueous binder dispersion is poured onto the fiber web as a stream perpendicular to said web and perpendicular to the run direction of said web.

The binder may be of the type of those normally used in this kind of production. In particular, it may be a plasticized polyvinyl acetate (PVAc) or a self-crosslinkable acrylic or styrene acrylic, or a urea-formaldehyde or melamine-formaldehyde. The excess binder may be removed by sucking through the forming fabric.

The purpose of the heat treatment step is to evaporate the water and to carry out the possible chemical reactions between the various constituents and/or to convert the binder precursor into binder and/or to give the binder its final structure. The heat treatment may be carried out by heating between 140 and 250° C., more generally between 180 and 230° C. The duration of the heat treatment will generally last from 2 seconds to 3 minutes and more generally from 20 seconds to 1 minute (for example 30 seconds at 200° C.). The veil may be dried and heat treated in an oven with hot air circulating through the belt.

FIG. 1 shows schematically an industrial process for the continuous production of a veil according to the invention. The glass fibers are introduced into a pulper at (g) and the cellulose fibers are introduced into the same pulper at (c) in the presence of white water and with stirring in order to form a dispersion. Next, the mixture may be poured into a storage tank 2 via the line 3, the function of the storage tank being to extend the time for mixing between the filaments and the white water. This storage tank is optional. The mixture is then taken via the line 4 into the line 5, where the stream of mixture coming from the line 4 joins a stream of recycled white water coming from the head box 6 via the line 7. At this point, the fiber content in the fiber/white water mixture is greatly reduced. White water is drained at 14 and possibly sucked out at 15 through the forming fabric 8, before being recycled via the line 17. This recycled water is then divided at 16, for example about 10% of it being returned to the pulper via the line 10 and about 90% being returned to the head box 6 via the lines 9, 7 and then 5. The water is circulated in the lines by the pumps 11, 12 and 13. The pump 11 is called the fan pump. The veil 18 being formed then makes a "belt jump" into the oven device 19 for carrying out the heat treatment, and the final veil is wound up at 20.

The invention makes it possible to produce veils whose tear strength may even be greater than 430 gf, or indeed greater than 450 gf, as measured by the ISO 1974 standard, this being so while still exhibiting a high tensile strength, generally greater than 22 kgf as measured according to the ISO 3342 standard adapted so that the width of the jig for cutting the test piece is 50 mm and the speed of movement of the grippers is 50 mm/min±5 mm/min. This value is appropriate in particular for a veil according to the invention whose glass/cellulose (excluding binder) mass ratio is from 2.4/97.5 to 14.6/85.3.

EXAMPLE

Described below is a method of implementation using a laboratory batch process. A cationic white water was prepared that contained:

0.25% by weight of hydroxyethyl cellulose (NATROSOL 250HHR brand from Hercules) as thickener;

0.015% by weight of Cytec AEROSOL C61 (a "complex of alkylguanidine-amine-ethanol in isopropanol" surfactant) as cationic dispersant; and water to make the white water composition up to 100%.

The white water exhibited the required cationicity with regard to the present invention, given that 2.6 ml of counterion at a concentration of $10^{-3}$ N were measured for 10 ml of white water.

The following were put into 5 liters of this white water:

3 grams of cellulose fiber suspension in water, the characteristics of which were as follows: refining to 60° SR, dryness 14.5% (i.e. 14.5% dry matter); and 8 grams of glass fiber with a filament diameter of about 13 μm, chopped to a length of about 18 mm.

The viscosity of the white water was 15 mPa·s at 20° C. before introduction of the cellulose and glass fibers.

After vigorously stirring this dispersion for 7 minutes, this predispersion was put into a rectangular (30 cm×30 cm) laboratory handsheet mold containing 25 liters of white water. The water was then drained off and the fiber mixture recovered on a forming fabric.

The veil formed on the fabric passed over a suction slot from which the excess white water was sucked out. The handsheet mold was then impregnated with a binder (of the self-crosslinkable urea-formaldehyde type) in an aqueous dispersion by immersion between two forming fabrics. The excess binder was removed by passing over a suction slot.

The sheet obtained was then dried and heat treated in a hot-air oven (90 seconds at 200° C.).

The invention resulted in a veil with a grammage of 100 g/m$^2$. This veil had a high tear strength. The table below gives tensile strength and tear strength values as a function of the glass/cellulose mass ratio:

| Glass/cellulose | 100/0 | 99/1 | 95/5 | 90/10 | 85/15 | 80/20 |
|---|---|---|---|---|---|---|
| Tear strength (gf) | 395 | 410 | 468 | 469 | 396 | 420 |
| Tensile strength (kgf) | 24 | 24 | 24 | 23 | 22 | 20 |

This table shows that the tear strength is 19% higher in the case of the veils containing 5% cellulose and 10% cellulose than in the case of the other veils, while still having a very high tensile strength.

COMPARATIVE EXAMPLE

Described below is a method of implementation using a laboratory batch process. An anionic white water was prepared that contained:

0.0044% by weight of anionic polyacrylamide (NALCO D 9641 brand from Nalco) as thickener;

0.0044% by weight of ethoxylated fatty alkylamine (SCHERCOPOL DSB 140 brand from Scher Chemicals) as cationic dispersant; and water to make the white water composition up to 100%.

The white water exhibited anionicity given that 1.6 ml of counterion (cationic titrating solution: Poly-DADMAC=Polydiallyldimethylammonium chloride) with a concentration of $10^{-3}$ N were measured for 10 ml of white water.

The following were put into 5 liters of this white water:

3 grams of cellulose fiber suspension in water, the characteristics of which were as follows: refining to 60° SR, dryness 14.5% (i.e. 14.5% dry matter); and 8 grams of glass fiber with a filament diameter of about 13 μm, chopped to a length of about 18 mm.

The viscosity of the white water was 2.6 mPa·s at 20° C. before introduction of the cellulose and glass fibers.

After vigorously stirring this dispersion for 7 minutes, this predispersion was placed in a rectangular (30 cm×30 cm) laboratory handsheet mold containing 25 liters of white water. The water was then drained off and the fiber mixture recovered on a forming fabric.

The distribution of the fibers on the fabric was very poor. All the fibers (glass and cellulose) flocculated owing to the anionicity of the white water. The fibrous network contained only reagglomerated fibers. It was possible to pass it over a suction slot, from which the excess white water was sucked out, to impregnate the fibers with a binder (of the self-crosslinkable urea-formaldehyde type) in an aqueous dispersion by immersion between two forming fabrics, to remove the excess binder by passage over a suction slot and to dry and heat treat the fibrous structure in a hot-air oven for 90 seconds at 200° C.

However, the fibrous structure obtained had no integrity and it was impossible to carry out mechanical strength tests.

The invention claimed is:

1. A veil, comprising:

2 to 12% by weight cellulose fibers based on a total weight of the veil;

70 to 80% by weight glass fibers based on the total weight of the veil; and 8 to 27% by weight binder based on the total weight of the veil;

wherein the veil is a dry veil, the cellulose fibers and glass fibers are homogenously dispersed in the veil, and a tear strength of the veil is greater than 430 gf as measured by ISO 1974.

2. The veil as claimed in claim 1, wherein the tear strength is greater than 450 gf.

3. The veil as claimed in claim 1, wherein a tensile strength of the veil is greater than 22 kgf as measured by ISO 3342 adapted so that a width of a jig for cutting a test piece is 50 mm and a speed of movement of grippers is 50 mm/min ±5 mm/min.

4. The veil as claimed in claim 1, wherein the veil comprises:

5 to 10% by weight cellulose based on a total weight of cellulose and glass in the veil; and 90 to 95% by weight glass based on the total weight of cellulose and glass in the veil.

5. The veil as claimed in claim 1, wherein the veil has a weight per unit area of from 20 to 150 g/m$^2$.

6. The veil as claimed in claim 1, wherein the veil has a weight per unit area of from 30 to 130 g/m$^2$.

7. The veil as claimed in claim 1, wherein the veil has a weight per unit area of about 100 $g/m^2$.

8. The veil as claimed in claim 1, wherein the glass fibers have a filament diameter of about 13 μm.

9. The veil as claimed in claim 1, wherein the glass fibers have a length of about 18 mm.

10. The veil as claimed in claim 1, wherein the binder is obtained by curing at least one member selected from the group consisting of a plasticized polyvinyl acetate (PVAc), a self-crosslinkable acrylic, a self-crosslinkable acrylic, a styrene acrylic, a urea-formaldehyde, and a melamine-formaldehyde.

11. The veil as claimed in claim 1, wherein the veil is wound into a roll.

12. A shingle, comprising the veil as claimed in claim 1, wherein the veil is impregnated with tar or asphalt.

* * * * *